United States Patent [19]

Horwinski

[11] 3,997,225

[45] Dec. 14, 1976

[54] GROUNDING TYPE ADAPTOR RECEPTACLE

[75] Inventor: Elwood R. Horwinski, Cheshire, Conn.

[73] Assignee: Product Concepts, Inc., Middlebury, Conn.

[22] Filed: July 3, 1975

[21] Appl. No.: 593,124

[52] U.S. Cl. ..... 339/14 R; 339/156 R

[51] Int. Cl.[2] ..... H01R 3/06

[58] Field of Search ..... 339/14 R, 154 R, 154 A, 339/156 R, 157 R, 159 R, 159 C, 166 R, 164 R, 164 M

[56] References Cited

UNITED STATES PATENTS

| | | | |
|---|---|---|---|
| 2,702,893 | 2/1955 | Paulson | 339/166 R |
| 2,970,286 | 1/1961 | Modrey | 339/14 R |
| 3,775,727 | 11/1973 | Wise | 339/156 R |

OTHER PUBLICATIONS

Hubbell Duplex Adapter, *Electrical Construction and Maintenance*, July 1961, p. 128.

*Primary Examiner*—Roy Lake
*Assistant Examiner*—Mark S. Bicks
*Attorney, Agent, or Firm*—H. Gibner Lehmann; K. Gibner Lehmann

[57] ABSTRACT

An electrical grounding-type adaptor receptacle providing, from a standard duplex wall outlet, multiple circuits to accommodate a plurality of electrical plugs. The adaptor includes a wall plate or housing which has the configuration of a truncated pyramid and is adapted to overlie and completely conceal the outlet opening of the wall receptacle. Two pairs of parallel-connected conductive prongs protrude from the rear of the housing and are adapted to be inserted in the recess pairs respectively of the wall outlet for electrical contact with the circuits thereof. Carried by the housing are multiple three-conductor sockets for receiving grounding-type appliance plugs, the sockets being connected in parallel with one another and with the parallel-connected prongs.

To provide the grounding function there is disposed within the housing an elongate conductor bar substantially in line with the sockets, the conductor bar having multiple spring fingers adapted to be engaged by the ground pins of the plugs. The conductor bar is secured by a mounting screw, which in turn is received in the grounded mounting nut in the wall outlet. The arrangement is such that the mounting screw for the adaptor operates to mechanically hold it in a position overlying the wall outlet, while at the same time providing an electrical ground connection for the conductor bar. Thus, three-circuit grounding type plugs which are inserted into the adaptor will have their third pins grounded at all times, regardless of whether the adaptor is employed with conventional two-circuit or three-circuit wall outlets.

2 Claims, 11 Drawing Figures

GROUNDING TYPE ADAPTOR RECEPTACLE

BACKGROUND

This invention relates generally to adaptor fittings for electrical wall outlets, and more particularly to adaptor fittings of the type capable of accommodating multiple three-prong electrical plugs, wherein one of the prongs serves to provide a grounding circuit for the electrical appliance being used.

In the past a number of devices have been proposed and produced for expanding the circuit capacity of existing wall outlets. One of the most common devices is known as a "cube tap", which is a small cube-shaped adaptor having two prongs extending from one side and adapted to be inserted in a wall outlet, and sockets on other faces respectively of the cube, adapted to receive electrical plugs. The most common type of cube tap employs a single pair of prongs together with three sockets. While such devices operated in a generally satisfactory manner, there was no provision for accepting electrical plugs having a third grounding pin or prong. Nor did the cube tap itself have such a grounding prong. As a result, their use with appliances such as electric saws, electric drills, etc. was somewhat hazardous, particularly where the device was intended to be used out of doors.

Most appliances which are manufactured today include a third wire in the electrical cord, connected to the casing of the appliance for grounding the same. However, many of the older standard wall outlets provide only two circuits, and thus are not adaptable to receive three-pronged plugs. In an effort to overcome this, several cube taps have been developed with provision for accepting grounding prongs. Such devices included a pigtail having a lug adapted to be received under the grounded wall plate mounting screw of the outlet. However, in many cases the user did not take the necessary time to loosen the mounting screw and insert the grounding lug thereunder. Under such circumstances, the safety feature provided by the three wire cord was completely defeated.

More recently, the Federal Government instituted a set of rules and regulations affecting and regulating the safety of office buildings and manufacturing facilities, in what is known as the Occupational Safety and Health Act (OSHA). Such regulations now require that all outlets and receptacles in manufacturing plants be of the grounded variety. These new regulations pose significant problems in older installations employing two-circuit outlets, since compliance requires removal of the old outlet and installation of new ones having three-circuit sockets. Since such wiring changes must be made by licensed electricians, these operations tend to be extremely costly. As a result, many companies have not undertaken the necessary modifications and are thus in violation of the present OSHA regulations. Such violations are currently resulting in fines of hundreds of dollars per violation when OSHA inspectors visit a particular plant or facility.

SUMMARY

The above problems with prior adaptors are obviated by the present invention which has for an object the provision of an improved electrical grounding-type adaptor receptacle for use with a standard wall outlet, the adaptor being simple in construction, reliable in operation, and being capable of quick and easy installation by unskilled persons in existing facilities without the necessity of expensive rewiring or bulky interface equipment. A related object is the provision of an adaptor receptacle as above which provides multiple three-circuit sockets of the type to receive a ground pin or prong on an electrical plug. Still another object is the provision of an adaptor receptacle which can be used with existing two-circuit electrical wall outlets, and which provides all the safety features of the newer three-circuit units. Yet another object of the invention is the provision of an electrical adaptor which can be assembled with a minimum of time and effort and at low overall cost, in order to provide a highly satisfactory solution to the problem of providing proper grounding capability for all electric appliances in a particular manufacturing or office facility.

The above objects are accomplished by the provision of a novel electrical receptacle-type adaptor comprising a housing or wall plate adapted to overlie and conceal the wall outlet, a pair of conductive prongs protruding from the rear of the wall plate and adapted to be received in recesses of the wall outlet for establishing electrical contact with the circuits thereof, and means defining electrical three-conductor sockets in the wall plate, two of the conductors thereof being connected respectively to the prongs, with conductive means providing an electrical connection from the third of the conductors to the ground portion of the wall outlet. The conductive means comprises an elongate conductor bar carried by the wall plate substantially in line with the sockets thereof. The wall plate includes a mounting screw adapted to be received in the grounded mounting nut of the wall outlet, and passing through a hole in the conductor bar to make positive electrical contact therewith. The conductor bar includes spring fingers which are adapted to receive respectively the ground prongs of electrical plugs which are inserted in the sockets. By such an arrangement, the ground prongs of such plugs are grounded through the conductor bar and mounting screw, the latter serving both as an electrical path for the ground circuit, and as a mechanical support for the wall plate. The arrangement is such that three-circuit electrical plugs can be employed with existing standard wall outlets of either the two-circuit or three-circuit type, while maintaining all of the safety features inherent in the latter.

Other features and advantages will hereinafter appear.

In the drawings, illustrating a preferred embodiment of the invention:

Figure 1:
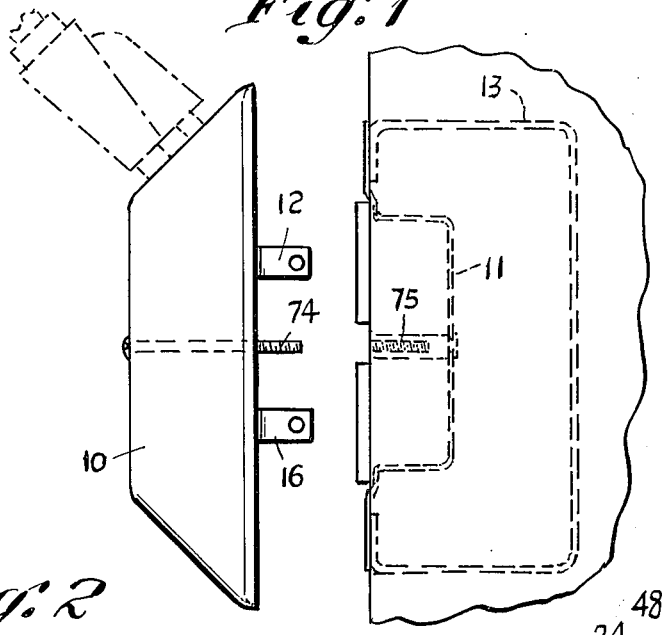
FIG. 1 is a side elevational view of the electrical adaptor of the present invention, shown about to be assembled to a typical duplex outlet box of the type employed in conventional manufacturing or office facilities.
Figure 2:
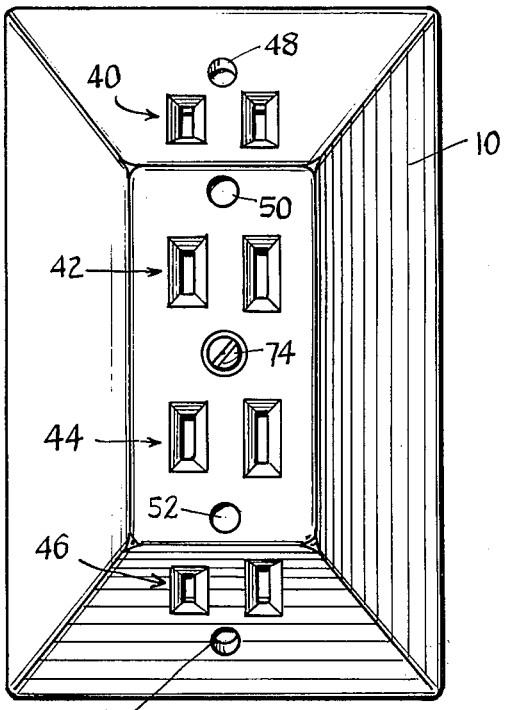
FIG. 2 is a front elevational view of the electrical adaptor of FIG. 1.
Figure 3:
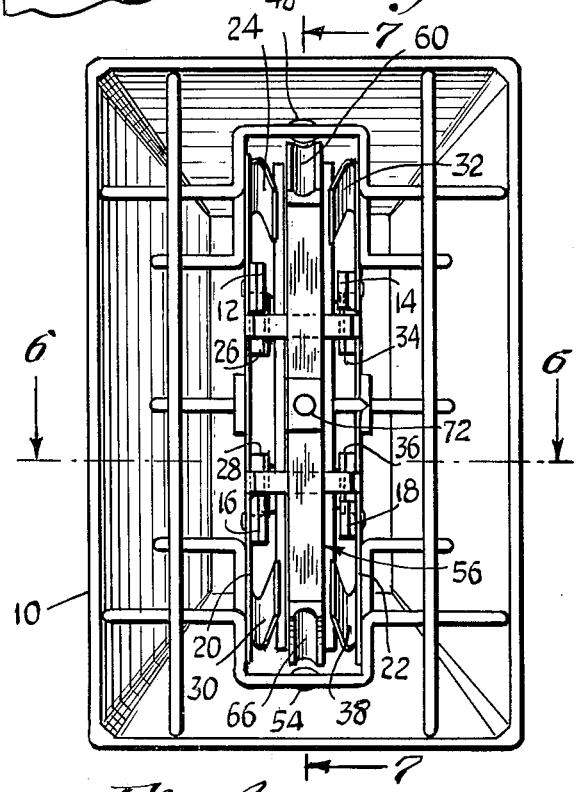
FIG. 3 is a rear elevational view of the electrical adaptor of FIG. 1.
Figure 5:
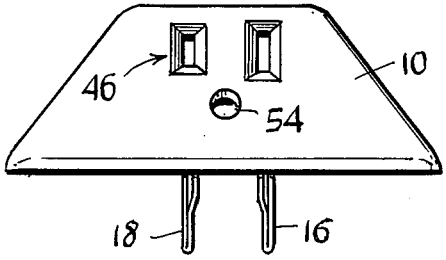
FIG. 5 is a bottom plan view of the adaptor of FIG. 1.
Figure 4:
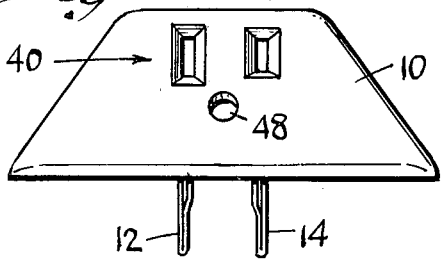
FIG. 4 is a top plan view of the adaptor of FIG. 1.
Figure 6:
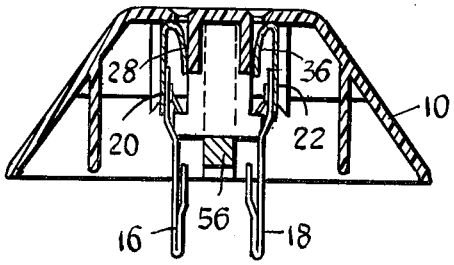
FIG. 6 is a section taken on line 6—6 of FIG. 3.

Referring to FIGS. 1–7 and in accordance with the present invention there is provided a novel and improved electrical receptacle-type adaptor for standard duplex wall outlets, the adaptor supplying multiple circuits to accommodate a plurality of electrical plugs. The device includes a housing or wall plate 10 which is constituted of plastic and has the configuration of a truncated pyramid. Protruding from the rear of the housing are two pairs of prongs 12, 14, and 16, 18 which are adapted to be received in corresponding recesses in the electrical wall outlet and to provide electrical contact with the circuits thereof. Prongs 12, 16 and 14, 18 are carried on contact strips 20, 22 respectively, the latter having reversely bent portions 24, 26, 28, 30 and 32, 34, 36, 38, in the form of spring fingers adapted to mechanically and electrically engage the prongs of electrical plugs which are inserted into the housing. In this connection, the plate has pairs of apertures 40, 42, 44 and 46 through which the plug prongs extend. In addition, supplementary apertures 48, 50, 52, 54 are provided for receiving the third prongs or grounding pins respectively of such electrical plugs. The contact strips and apertures thus constitute four sockets in the housing, two being centrally disposed, and two being located at the inclined end faces of the housing.

Referring for the moment to FIGS. 7–10, there is carried by the housing an elongate conductor bar generally designated by the numeral 56, the bar being substantially aligned with the contact strips 20, 22 and interposed therebetween. As shown, the bar 56 includes a base portion 58 together with four upstanding spring fingers 60, 62, 64, 66. Disposed between the fingers 60, 62 is a solid abutment portion 68. Similarly, disposed between the fingers 64, 66 is a second solid abutment portion 70. The finger 62, together with the solid portion 68, thus form a curved socket which receives the grounded pin of an electrical plug that is inserted into the housing 10 through the apertures 42, 50. Similarly, the spring finger 64 and solid portion 70 of the bar 56 receive the ground pin of an electrical plug which is inserted into the apertures 44, 52 of the housing 10. In an analogous manner, the spring fingers 60 and 66 respectively form two half-sockets which engage one side of the ground pins of plugs inserted into the end sockets of the wall plate, through apertures 40, 48 and 46, 54. The solid abutment portions 68, 70 constitute fixed, positioner devices and guides for the inserted plugs to maintain their alignment.

Referring again to FIG. 7, it is seen that the conductor bar includes a central aperture 72 which receives a screw 74 extending through the front face of the housing 10. The screw 74 is adapted to be received in the wall plate mounting nut of the duplex wall outlet. In most installations, this nut is in the form of a threaded metal socket which is electrically connected to the grounded portion of the outlet box, which in turn is connected to ground through the sheath of BX cable or through the third wire of other cables such as Romex. FIG. 1 shows an adaptor constructed in accordance with the present invention being installed in such a duplex wall outlet, the latter being indicated by the numeral 11 and including a grounded outlet box 13. The wall plate mounting nut is designated 75 in FIG. 1 and is electrically connected to the grounded box through the outlet 11.

Figure 7:
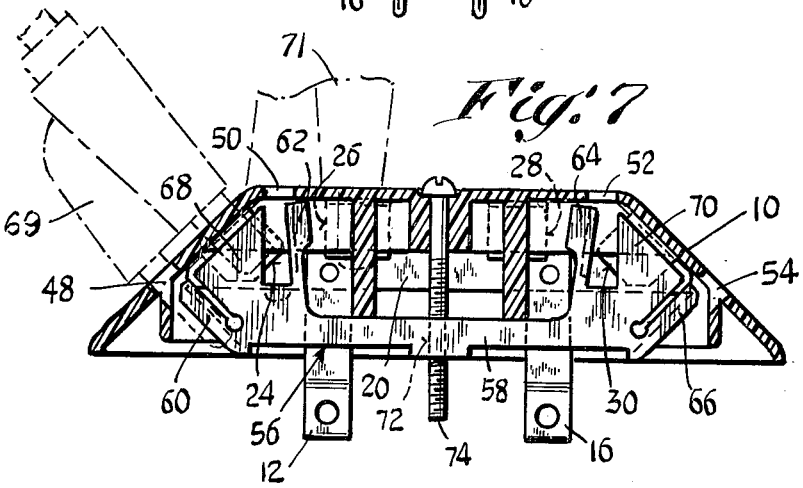
FIG. 7 is a section taken on line 7—7 of FIG. 3.
Figure 8:
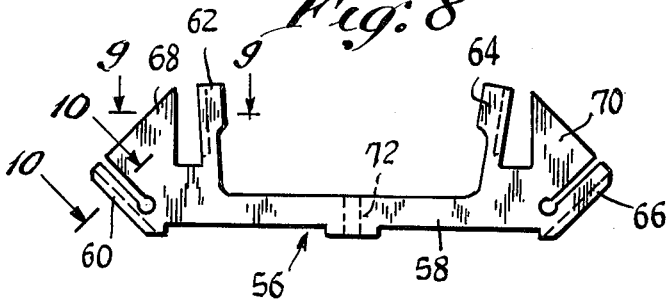
FIG. 8 is a side elevational view of a grounding conductor bar employed in the adaptor of FIGS. 1–7.
Figure 9:
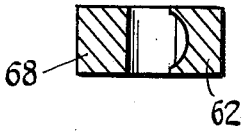
FIG. 9 is a section taken on line 9—9 of FIG. 8.
Figure 10:
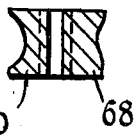
FIG. 10 is a section taken on line 10—10 of FIG. 8.

By such an arrangement, merely the insertion of the plugs into the sockets of the housing 10 results in the third prongs of such plugs being respectively grounded by the conductor bar 56 and mounting screw 74, the latter serving both as part of the electrical circuit which effects the grounding, and as a mechanical mounting for the housing. FIG. 7 shows two electrical plugs 69, 71 inserted in the adaptor, and illustrating their grounding pins received in the sockets formed by the fingers 60, 62 and abutment portion 68 of the conductor bar 56. In FIG. 1, the ground connection between the mounting nut 75 and the grounded outlet box 13 is made through internal conductors carried by the outlet 11.

All that is necessary in order to effect installation of the improved adaptor of the present invention is to remove the mounting screw for the existing wall plate of the standard duplex wall outlet, placing the receptacle-type adaptor of the present invention over the outlet such that the protruding pins 12, 14, thereof are received in the corresponding recesses of the existing wall outlet socket, as shown in FIG. 1, and securing the mounting screw 74 to the mounting nut 75. The housing is adapted to overlie and completely conceal the existing wall outlet, so as to present a neat, finished appearance.

The above construction is seen to have a number of distinct advantages. The spring fingers 62, 64 are flexible and capable of bending movement. This will enable the finger 62 to be slightly bent toward the solid portion 68 prior to installation of the device, in order to insure a snug fit with the ground pin of a three prong plug. Similarly, finger 64 can be bent toward the solid portion 70. The same is true of the contact fingers 60, 66, which can be urged in directions away from one another prior to assembly, in order to insure that the insertion of the corresponding plug will result in firm engagement of its grounding pin with the corresponding half socket formed by these fingers respectively.

Figure 11:
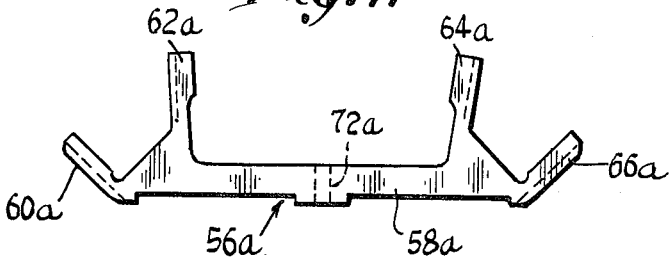
FIG. 11 is a side elevational view similar to FIG. 8 of a modified grounding conductor bar adapted to be substituted for the bar of FIGS. 8–10, and constituting another embodiment of the invention.

Another embodiment of the invention is shown in FIG. 11, illustrating a somewhat modified conductor bar **56*a* adapted to be substituted for the bar 56 in the embodiment of FIGS. 1–7. The bar includes a base portion 58*a* together with four upstanding spring fingers 60*a*, 62*a*, 64*a* and 66*a*. In the present instance, there are no solid abutment portions similar to those designated 68, 70 in FIG. 8, and I have found that the half sockets formed by the fingers 62*a* and 64*a*, respectively provide an adequate surface for engagement with the grounded pins of electrical plugs that are inserted into the housing 10 through the apertures 42, 50 or 44, 52. The construction of FIG. 11 is seen to have the advantage that less material is employed, which results in a lower overall cost, as well as a simpler device. As in the previous embodiment, a hole 72*a* is provided to receive the screw 74, by which the bar 56*a* is secured in the housing 10.** Otherwise, the operation of this embodiment is similar to that of the device shown in FIGS. 1–10, and accordingly and not be repeated.

It is to be especially noted that the adaptor of the present invention can be used with existing standard wall outlets regardless of whether or not such outlets have sockets of the type capable of accommodating ground pins. By the present construction, no reliance is placed upon the existence of such special sockets. Instead, the grounding path through the adaptor is made via the conductor bar 56 and mounting screw 74. As a result, the present device can be readily adapted to fit virtually all existing installations, without the need for extensive rewiring, circuit changes, interface equipment, etc. Consequently, the overall cost of having such devices installed is extremely low. By virtue of the fact that a single mounting screw is employed to both mechanically secure the housing 10 in position and mount the conductor bar 56, a number of separate parts required is reduced to an absolute minimum. Accordingly, there is realized a substantial saving in manufacturing costs and assembly time.

From the above it can be seen that I have provided a novel and improved electrical receptacle-type adaptor which is both extremely simple in construction and has been found to provide excellent reliability in insuring that the third prong of the plug connected to an appliance is indeed grounded. In addition, it is noted that the device is extremely simple to install, and requires virtually no maintenance. The adaptor is thus seen to provide a distinct advance and improvement in the technology of electrical adaptors.

Variations and modifications are possible without departing from the spirit of the invention.

I claim:

1. An electrical receptacle type adaptor providing from a standard wall outlet having a ground portion, multiple circuits to accommodate up to four three-prong grounding-type electrical plugs, comprising in combination:

a. a wall plate adapted to overlie the wall outlet, b. a pair of conductive prongs protruding from the rear of the wall plate and adapted to be received in the recesses of the wall outlet for establishing electrical contact with the circuits thereof, c. means defining an electrical three-conductor socket in the wall plate, two of the said three conductors thereof being connected respectively to said prongs, d. conductive means providing an electrical connection from the third of said conductors to the ground portion of said wall outlet, and e. means defining three additional, three-conductor sockets in the wall plate adapted to receive three additional electrical plugs respectively, two of the said three conductors of each socket being connected respectively to said prongs, f. said sockets being substantially aligned with one another, g. said conductive means comprising a single, one-piece elongate solid conductor bar extending adjacent said aligned sockets, each end of said bar having a pair of integral transverse spring contact fingers disposed angularly with respect to each other and adapted to mechanically engage and electrically contact the ground pins respectively of the plugs inserted into said sockets, h. said bar including non-yielding abutment portions interposed between the spring fingers of each pair, respectively, i. said abutment portions each cooperating with only one of the fingers of each pair for frictional engagement with the ground pin of a plug and providing a non-yielding, fixed positioner device and guide for said plug to maintain the alignment thereof.

2. The invention as defined in claim 1, wherein:

a. each of the fingers has an elongate, concave, pin contact surface located between the opposite flat side edges of the bar.

* * * * *